US010697643B2

(12) United States Patent
Yamashita et al.

(10) Patent No.: US 10,697,643 B2
(45) Date of Patent: Jun. 30, 2020

(54) COOKER

(71) Applicant: Panasonic Intellectual Property Management Co., Ltd., Osaka (JP)

(72) Inventors: Seiichi Yamashita, Shiga (JP); Takahiro Hayashi, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 293 days.

(21) Appl. No.: 15/573,011

(22) PCT Filed: Aug. 23, 2016

(86) PCT No.: PCT/JP2016/003818
§ 371 (c)(1),
(2) Date: Nov. 9, 2017

(87) PCT Pub. No.: WO2017/033458
PCT Pub. Date: Mar. 2, 2017

(65) Prior Publication Data

US 2018/0119961 A1 May 3, 2018

(30) Foreign Application Priority Data

Aug. 26, 2015 (JP) ..... 2015-166744

(51) Int. Cl.
*F24C 7/02* (2006.01)
*H05B 6/76* (2006.01)
(Continued)

(52) U.S. Cl.
CPC ..... *F24C 7/02* (2013.01); *F24C 7/04* (2013.01); *H05B 6/6473* (2013.01); *H05B 6/76* (2013.01)

(58) Field of Classification Search
CPC ... F24C 7/02; F24C 7/04; F24C 15/16; H05B 6/6473; H05B 6/76; H05B 6/64; H05B 6/6408; H05B 6/6429; H05B 6/6402
See application file for complete search history.

(56) References Cited

U.S. PATENT DOCUMENTS 4,303,817 A 12/1981 Klement et al.
2016/0330801 A1 11/2016 Hayashi et al.

FOREIGN PATENT DOCUMENTS

DE 3738267 * 5/1989
DE 3738267 A1 5/1989
(Continued)

OTHER PUBLICATIONS

International Search Report of PCT application No. PCT/JP2016/003818 dated Nov. 29, 2016.
(Continued)

*Primary Examiner* — Shawntina T Fuqua
(74) *Attorney, Agent, or Firm* — Brinks Gilson & Lione

(57) ABSTRACT

In a cooker according to the present disclosure, a convection heater for executing a convection mode and a circulation fan are disposed in a convection forming space that is in communication with a heating chamber, and a fan driver is disposed outside of the convection forming space. The cooker includes a leakage suppression mechanism for suppressing a microwave leak from the convection forming space. The leakage suppression mechanism is formed by a coaxial seal for setting a distance between opposing faces, i.e., between a circulation fan shaft passing through a first wall forming the convection forming space and the first wall to a predetermined distance or smaller. Therefore, a microwave leak from a mechanism for executing the convection mode is suppressed, and heat cooking with a microwave-heating mode can highly effectively be performed.

12 Claims, 9 Drawing Sheets

(51) Int. Cl.
*H05B 6/64* (2006.01)
*F24C 7/04* (2006.01)

(56) References Cited

FOREIGN PATENT DOCUMENTS

| | | | | |
|---|---|---|---|---|
| DE | 4105300 | | * | 8/1992 |
| EP | 6997 | A1 | | 1/1980 |
| JP | 54-000811 | Y | | 1/1979 |
| JP | 0006997 | | * | 1/1980 |
| JP | 56-117498 | U | | 9/1981 |
| JP | 58-050164 | Y | | 11/1983 |
| JP | 8-247473 | | | 9/1996 |
| JP | 10-003985 | | * | 1/1998 |
| JP | 2006-275390 | | | 10/2006 |
| WO | 2015/062754 | A1 | | 5/2015 |
| WO | 2015/118867 | | | 8/2015 |

OTHER PUBLICATIONS

English Translation of Chinese Search Report dated Oct. 9, 2018 for the related Chinese Patent Application No. 201680026922.7.
The Extended European Search Report dated Aug. 3, 2018 for the related European Patent Application No. 16838808.0.

* cited by examiner

COOKER

TECHNICAL FIELD

The present disclosure relates to cookers used to microwave-heat an object by radiating microwaves, and, in particular, relates to a commercial cooker used as a cooking apparatus in commercial facilities including stores and restaurants such as convenience stores and fast-food restaurants.

BACKGROUND ART

In order to be able to respond to various menus, commercial cookers used in stores and restaurants such as convenience stores and fast-food restaurants are configured to include, in addition to a microwave-heating mode with which an object is heat cooked by radiating microwaves, a grill mode with which the object is heat cooked through radiation heating using a heater, and a convection mode with which the object is heat cooked by using a fan to circulate air heated by the heater in a convection manner in a heating chamber.

The commercial cookers used in stores and restaurants are required to securely execute each heating process for heat cooking at a precise temperature and a precise time. In addition, for the commercial cookers, shortening a cooking time is important to promptly respond to an order of a customer. To achieve such requirements, the commercial cookers having a greater high-frequency output for microwave-heating are used, and a heater that consumes greater power is often used as a heating source in the grill mode and the convection mode.

As described above, in the commercial cookers, various devices having a greater output are used to shorten a cooking time. In particular, the commercial cookers capable of simultaneously executing the microwave-heating mode with which microwaves are irradiated and at least one of the grill mode and the convection mode are required to highly effectively use devices having a greater output to shorten a cooking time.

Controlling a speed of a circulation fan in accordance with a type of an object and a heating method is also proposed (e.g., see PTL 1).

CITATION LIST

Patent Literature

PTL 1: Unexamined Japanese Patent Publication No. 2006-275390

SUMMARY OF THE INVENTION

The present disclosure has an object to provide a cooker at least having a microwave-heating mode and a convection mode, which is capable of highly effectively performing heat cooking with the microwave-heating mode by suppressing a microwave leak in a mechanism for executing the convection mode to shorten a cooking time during the microwave-heating mode.

A cooker according to an aspect of the present disclosure includes a heating chamber configured to accommodate and heat an object, a microwave-heating mechanism configured to form microwaves and radiate the microwaves into the heating chamber to heat the object with the microwave-heating mode, a convection-heating mechanism configured to heat the object with the convection mode, and a microwave leak suppression mechanism configured to suppress a microwave leak. The convection-heating mechanism includes a circulation fan for taking air from the heating chamber and for blowing the air into the heating chamber, a convection heater for heating the air taken from the heating chamber by the circulation fan, a hot air guide for guiding the air taken from the heating chamber by the circulation fan toward the convection heater, and for guiding a direction of the hot air blown into the heating chamber by the circulation fan toward a desired position in the heating chamber, and a fan driver for driving a circulation fan shaft for rotating the circulation fan. The convection heater and the circulation fan are disposed in a convection forming space that is in communication with the heating chamber. The fan driver is disposed outside of the convection forming space. The microwave leak suppression mechanism has a coaxial seal mechanism for forming a gap between the circulation fan shaft passing through a first wall forming the convection forming space and the first wall and setting the gap between opposing faces of the circulation fan shaft and the first wall to a predetermined distance or smaller, and suppresses a microwave leak from the convection forming space.

According to the present disclosure, a leak of microwaves radiated in the heating chamber during heat cooking with the microwave-heating mode from a mechanism for executing heat cooking with the convection mode can significantly be suppressed. Therefore, the cooker for highly effectively performing heat cooking with the microwave-heating mode can be provided.

DESCRIPTION OF EMBODIMENT

Figure 1:
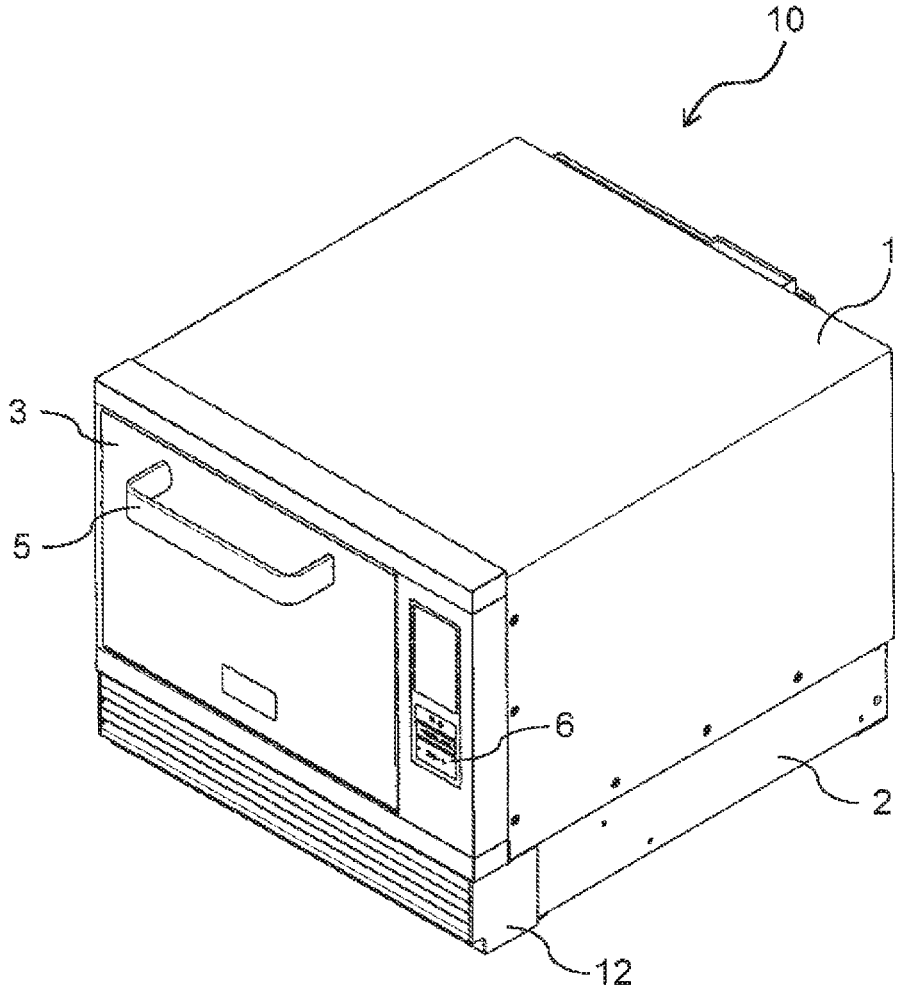
FIG. 1 is a perspective view of a cooker according to an exemplary embodiment of the present disclosure when its door is closed.

A cooker according to a first aspect of the present disclosure includes a heating chamber configured to accommodate and heat an object, a microwave-heating mechanism configured to form microwaves and radiate the microwaves into the heating chamber to heat the object with a microwave-heating mode, a convection-heating mechanism configured to heat the object in a convection mode, and a microwave leak suppression mechanism configured to suppress a microwave leak. The convection-heating mechanism includes a circulation fan for taking air from the heating chamber and for blowing the air into the heating chamber, a convection heater for heating the air taken from the heating chamber by the circulation fan, a hot air guide for guiding the air taken from the heating chamber by the circulation fan toward the convection heater, and for guiding a direction of the hot air blown into the heating chamber by the circulation fan toward a desired position in the heating chamber, and a fan driver for driving a circulation fan shaft for rotating the circulation fan. The convection heater and the circulation fan are disposed in a convection forming space that is in communication with the heating chamber. The fan driver is disposed outside of the convection forming space. The microwave leak suppression mechanism has a coaxial seal mechanism for forming a gap between the circulation fan shaft passing through a first wall forming the convection forming space and the first wall and setting the gap between opposing faces to a predetermined distance or smaller, and suppresses a microwave leak from the convection forming space.

As described above, the cooker according to the first aspect of the present disclosure configured to have the microwave-heating mode and the convection mode can suppress a microwave leak in the convection-heating mechanism for executing the convection mode. Therefore, heat cooking with the microwave-heating mode can highly effectively be performed to shorten a cooking time during the microwave-heating mode.

In a cooker according to a second aspect of the present disclosure, in the first aspect, the gap between opposing faces, i.e., between the circulation fan shaft and the first wall, may be 3.0 mm or smaller.

In a cooker according to a third aspect of the present disclosure, in the second aspect, the microwave leak suppression mechanism may include a fan support for fixing the circulation fan at a predetermined position with respect to the circulation fan shaft, and an annular first bushing fixed so as to cover an inner face of a through hole on the first wall, into which the circulation fan shaft passes through. In addition, with the fan support being passed through the first bushing, a gap between opposing faces, i.e., between the fan support and the first bushing, may be 3.0 mm or smaller.

In a cooker according to a fourth aspect of the present disclosure, the fan support in the third aspect may include a plain face portion having a plain face for fixing the circulation fan at a predetermined position, and a cylindrical portion for covering an outer peripheral surface of the circulation fan shaft that is orthogonal to the plain face of the plain face portion. A gap between opposing faces, i.e., between an inner peripheral surface of the first bushing and an outer peripheral surface of the cylindrical portion, may be 3.0 mm or smaller, and a gap between opposing faces, i.e., between the first bushing and the plain face portion, may be 3.0 mm or smaller.

In a cooker according to a fifth aspect of the present disclosure, a second wall for covering the first wall forming the convection forming space in the fourth aspect with a space interposed may be included. In addition, the circulation fan shaft may pass through the first wall and the second wall, the fan driver may join the circulation fan shaft passing through the second wall, and other faces than a face facing the heating chamber in the convection forming space may be configured in a double wall structure.

In a cooker according to a sixth aspect of the present disclosure, as the microwave leak suppression mechanism in the fifth aspect, a leak suppression space surrounding the circulation fan shaft with a leak suppression wall provided to join the first wall and the second wall may be formed.

In a cooker according to a seventh aspect of the present disclosure, as the microwave leak suppression mechanism in the fifth aspect, a metal mesh seal provided in an annular shape around the circulation fan shaft passing through the second wall may be provided on a side of the second wall, on which the fan driver is provided.

In a cooker according to an eighth aspect of the present disclosure, the metal mesh seal in the seventh aspect may be pressed and fixed onto the second wall by a seal pressure plate into which the circulation fan shaft passes through, and the seal pressure plate may form a microwave sealing space inside of the metal mesh seal.

In a cooker according to a ninth aspect of the present disclosure, as the microwave leak suppression mechanism in the eighth aspect, a second bushing having a coaxial seal function, which is fixed to the seal pressure plate and disposed on the outer peripheral surface of the circulation fan shaft to have a predetermined gap, may be provided.

In a cooker according to a tenth aspect of the present disclosure, in the ninth aspect, a gap between opposing faces, i.e., between an inner peripheral surface of the second bushing and the outer peripheral surface of the circulation fan shaft, may be 1.0 mm or smaller.

A cooker according to an exemplary embodiment of the present disclosure, which is capable of executing a microwave-heating mode, a grill mode and a convection mode, will now be described herein. In particular, in the exemplary embodiment described below, the cooker that is a commercial microwave oven used in stores and restaurants such as convenience stores and fast-food restaurants will now be described herein with reference to the accompanied drawings. A configuration of the cooker according to the present disclosure is not limited to a configuration of the commercial microwave oven described in the below exemplary embodiment, but includes a configuration of a cooker based on a technical idea equivalent to a technical idea described in the below exemplary embodiment.

The commercial cooker according to the exemplary embodiment of the present disclosure will now be described herein with reference to the accompanied drawings. Note however that some or all of the drawings are schematically rendered for illustration purpose, and components shown in the drawings do not always indicate their actual relative sizes and positions.

Figure 2:
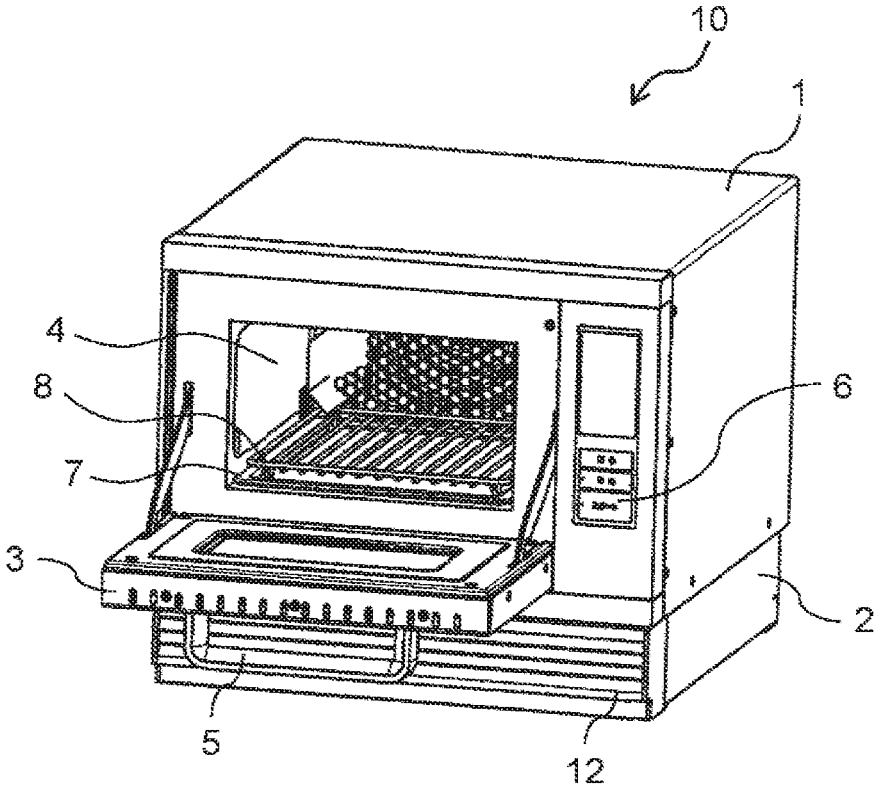
FIG. 2 is a perspective view of the cooker according to the exemplary embodiment of the present disclosure when its door is open.

FIG. 1 is a perspective view illustrating an appearance of cooker 10 according to the exemplary embodiment of the present disclosure when its door formed on a front face of cooker 10 is closed. In FIG. 2, the door of cooker 10 shown in FIG. 1 is open, and thus a heating chamber formed in cooker 10 is open.

Cooker 10 according to this exemplary embodiment is a commercial microwave oven used in stores and restaurants, in particular, used in convenience stores and fast-food restaurants, has a maximum output of approximately 2000 W, and is configured to be capable of switching an output in plural steps.

As shown in FIGS. 1 and 2, cooker 10 includes main body 1 configuring an outer case of heating chamber 4, machine chamber 2 provided under main body 1 so as to support main body 1, and door 3 attached on a front face side of main body 1. Detachable front grille panel 12 is provided on a front face side of machine chamber 2.

As shown in FIG. 2, heating chamber 4 is formed inside of main body 1. Heating chamber 4 is a space formed in an approximately rectangular parallelepiped shape having an opening on its front face side (door side) for internally accommodating an object. In the following description, the side of heating chamber 4, on which the opening is formed, is defined as a front side of cooker 10, and a back side of heating chamber 4 is defined as a rear side of cooker 10. A right side of cooker 10 when cooker 10 is viewed from front is simply referred to as a right side, and a left side of cooker 10 when cooker 10 is viewed from front is simply referred to as a left side.

Door 3 is vertically openably attached on the front face side of main body 1 so as to cover the opening on a front of heating chamber 4. Door 3 is configured in such a manner that a user holds handle 5 provided on door 3 to open or close door 3. When door 3 is closed as shown in FIG. 1, heating chamber 4 is internally formed in a closed space so that an accommodated object is heat processed with microwaves, for example. When door 3 is open as shown in FIG. 2, the user can put or remove an object into or from heating chamber 4.

In cooker 10 according to this exemplary embodiment, operation unit 6 is provided on a right side of a front face of main body 1. Operation unit 6 is provided with operation buttons for setting a processing condition for heat cooking in cooker 10, and a display screen.

As shown in FIG. 2, heating chamber 4 is internally disposed with tray 7 made of ceramics (specifically, made of cordierite (made of ceramics composed of 2MgO.2Al2O3.5SiO2)), and wire rack 8 made of stainless steel in an accommodatable manner. Wire rack 8 is a loading portion formed from a mesh member for loading an object, and allows hot air to effectively circulate under the object. Tray 7 is provided under wire rack 8 to catch fat components, for example, dropping from the object on wire rack 8.

In cooker 10 according to this exemplary embodiment, machine chamber 2 under heating chamber 4 is provided with magnetron 35 (see FIG. 4 described later) served as a microwave generator. Microwaves generated from magnetron 35 radiate, via a wave guide, from microwave radiation holes formed on the wave guide and openings formed on a bottom face side of heating chamber 4. The microwaves radiated from the microwave radiation holes on the wave guide and the openings formed on a bottom face of heating chamber 4 into heating chamber 4 will be stirred by a stir (agitator). By the cooker configured as described above, the object accommodated in heating chamber 4 can be microwave heated.

In cooker 10 according to this exemplary embodiment, a grill heater formed based on a sheath heater is provided on a ceiling side of heating chamber 4 so that a grill mode is executed to directly heat the object in heating chamber 4 with radiant heat of the grill heater.

In addition, convection device 30 (described later, see the cross-sectional view shown in FIG. 4) configured to supply hot air into heating chamber 4 is provided behind a rear wall of heating chamber 4. Convection device 30 has a function to take air from a central portion of heating chamber 4, to heat the taken air, and to blow the hot air into heating chamber 4. As described above, convection device 30 supplies hot air into heating chamber 4, and the hot air causes a circulating flow to occur in heating chamber 4. For example, convection device 30 takes air from a central area of heating chamber 4, heats the taken air, and blows the hot air from a front side of the bottom face and a front side of a ceiling into heating chamber 4 to circulate the hot air.

Figure 3:
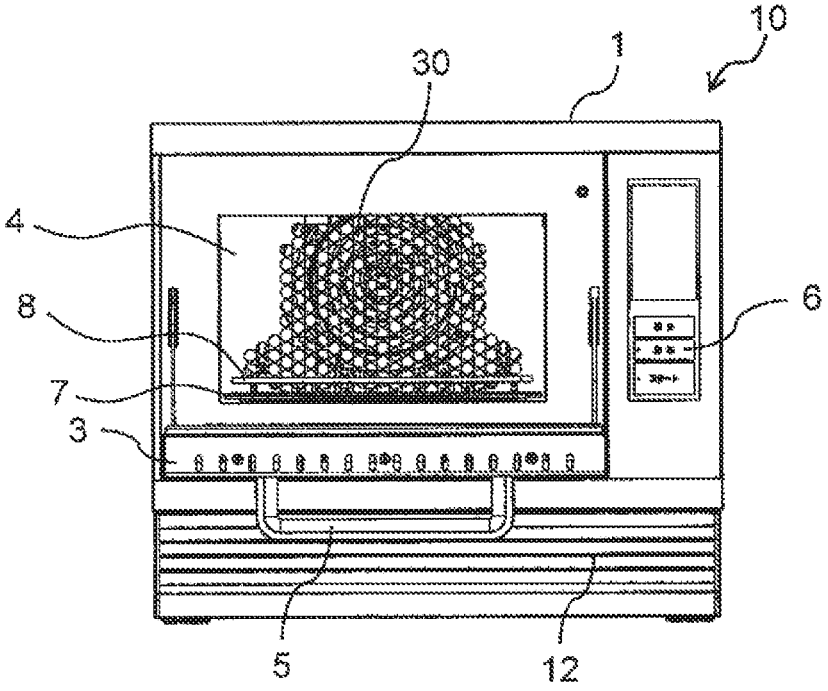
FIG. 3 is a front view of the cooker according to the exemplary embodiment of the present disclosure when its door is open.

FIG. 3 is a front view of cooker 10 according to this exemplary embodiment when door 3 is open, and illustrates that convection device 30 is provided behind rear wall 31 of heating chamber 4.

As described above, cooker 10 according to this exemplary embodiment is configured to be capable of separately or simultaneously performing heating with microwaves supplied from magnetron 35 served as a microwave generator, heating through radiation of heat using the grill heater provided on an upper side (ceiling wall side) of heating chamber 4, and heating through a circulating flow of hot air using convection device 30.

Cooker 10 according to this exemplary embodiment is configured such that a heater that is a larger heat source does not lie under the object accommodated in heating chamber 4. Therefore, a liquid such as a fat component dropping from the object does not come into contact with a heater, and thus a highly safe cooker can be achieved, where neither smoke nor a fire occurs.

Machine chamber 2 is internally provided with components including magnetron 35 served as a microwave generator for generating microwaves, inverter 36 (see FIG. 4) for driving magnetron 35, and cooling fan 37 (see FIG. 4) for cooling magnetron 35, inverter 36, and other components.

In this exemplary embodiment, two magnetrons 35 are used, and a total output ranges from 1200 W to 1300 W inclusive. Microwaves output from the two magnetrons respectively transmit into two wave guides, and radiate into heating chamber 4 via microwave radiation openings respectively formed on the wave guides and openings formed on the bottom face of heating chamber 4. The microwaves are stirred by stir 32, and radiated into heating chamber 4.

Inverter 36 drives each of magnetrons 35. Two inverters 36 for respectively driving two magnetrons 35 are provided in machine chamber 2. In machine chamber 2, a plurality of cooling fans 37 is also disposed for respectively cooling magnetrons 35 and inverters 36. In this exemplary embodiment, four cooling fans 37 are provided to form two pairs. Cooling fans 37 respectively take outside air from front grille panel 12 provided on a front face of machine chamber 2, and blow the taken outside air rearward to sequentially cool two pairs of inverters 36 and magnetrons 35 and other components arranged in a file to form the microwave-heating mechanism provided in machine chamber 2.

A power supply circuit board is provided in machine chamber 2, and a cooling fan for cooling the power supply circuit board is further provided. Upon the cooling fan starts, outside air is taken from front grille panel 12 provided on the front face of machine chamber 2 to cool various devices including the power supply circuit board in machine chamber 2.

In this exemplary embodiment, four cooling fans 37 arranged in parallel to cool heating portions of inverters 36 and magnetrons 35 and other components and the cooling fan for cooling the power supply circuit board is formed by multi-blade fans installed so that their rotation axes align in a straight line. The cooling fans are configured to take air in an axial direction of each of the rotation axes, and to blow the air toward a rear of machine chamber 2 in an outer peripheral direction. The air blown toward the rear of machine chamber 2 passes through an exhaust duct disposed on a rear face of main body 1 and a gap between a ceiling wall of heating chamber 4 and an upper face wall of main body 1, and exits from the front face side of main body 1. As described above, air flowing from the cooling fans prevents the upper face wall around a rear wall of main body 1 from being heated.

Internal Structure of Cooker

Figure 4:
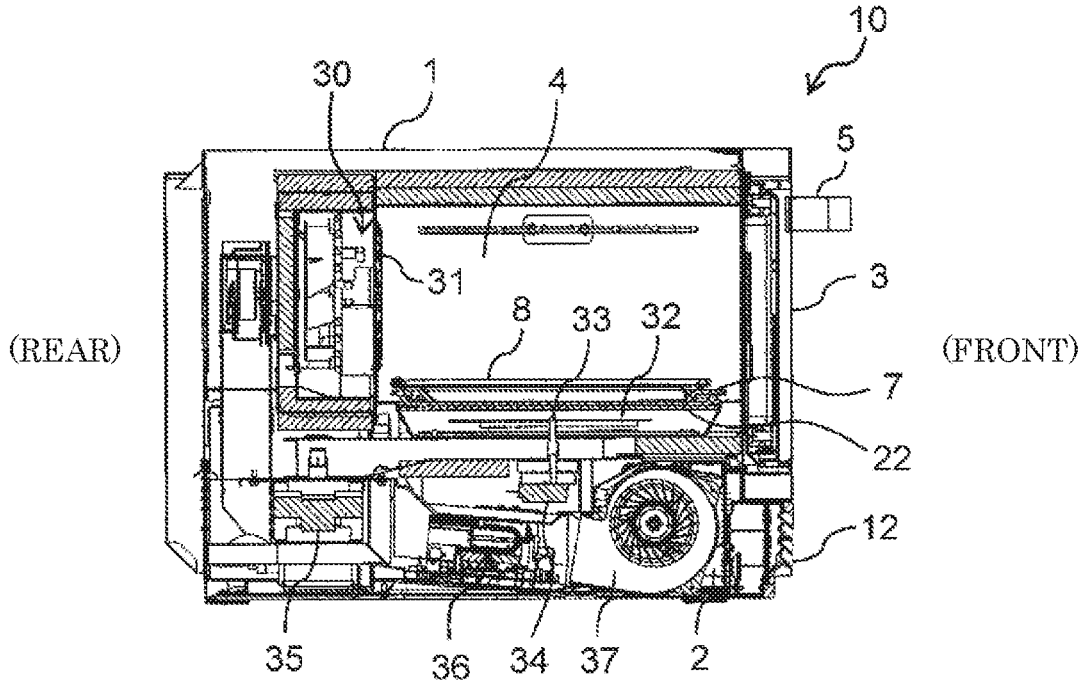
FIG. 4 is a vertical cross-sectional view of the cooker according to the exemplary embodiment of the present disclosure.

An internal structure of cooker 10 will now be described herein with reference to FIG. 4. FIG. 4 is a vertical cross-sectional view of cooker 10 when viewed in a front-rear direction, in which the front side (front) faces rightward in FIG. 4.

As shown in FIG. 4, tray 7 is loaded on tray stand 22. Tray stand 22 is provided on the bottom face of heating chamber 4 to support tray 7. In this exemplary embodiment, tray stand 22 is made of a ceramics plate material that allows microwaves to pass through.

Stir (agitator) 32 for stirring microwaves to be radiated into heating chamber 4 is provided between tray stand 22 and the bottom face of heating chamber 4. Stir 32 is a rotor blade configured to rotate about stir shaft 33 to stir microwaves. Motor 34 is provided in machine chamber 2 to rotate and drive stir 32.

Machine chamber 2 is internally provided with the microwave-heating mechanism including magnetrons 35 served as microwave generators for generating microwaves, inverters 36 for driving magnetrons 35, and cooling fans 37 for cooling magnetrons 35 and inverters 36.

In this exemplary embodiment, as described above, two pairs of magnetrons 35 and inverters 36 are provided for generating a higher output, and four cooling fans 37 cool magnetrons 35 and inverters 36.

The plurality of cooling fans 37 (in this exemplary embodiment, four cooling fans 37) provided in machine chamber 2 cool magnetrons 35 and inverters 36, and single cooling fan 37 cools the power supply circuit board disposed in machine chamber 2 and other components. Upon cooling fans 37 start, outside air is taken from front grille panel 12 attached on the front face of machine chamber 2, passes through an outside air intake port formed on the front face of machine chamber 2, and is then taken into machine chamber 2. The air taken into machine chamber 2 cools members in machine chamber 2, passes through the exhaust duct disposed on the rear face of main body 1 and the gap between the ceiling wall of heating chamber 4 and the upper face wall of main body 1, and exits from the front face side of main body 1.

A plurality of openings 38 is formed on rear wall 31 (see FIG. 5 described later) configuring a back wall of heating chamber 4. Openings 38 on rear wall 31 in this exemplary embodiment are a plurality of punching holes formed through punching on rear wall 31 made of a plate material. Convection device 30 configured to take air in heating chamber 4, to heat the air to generate hot air, and to blow the hot air into heating chamber 4 is provided behind rear wall 31. A space in which convection device 30 is disposed is separated from an inner space of heating chamber 4 by rear wall 31, and is in communication with the inner space of heating chamber 4 through the plurality of openings 38 formed on rear wall 31. In this exemplary embodiment, convection device 30 is served as a convection-heating mechanism.

Figure 5:
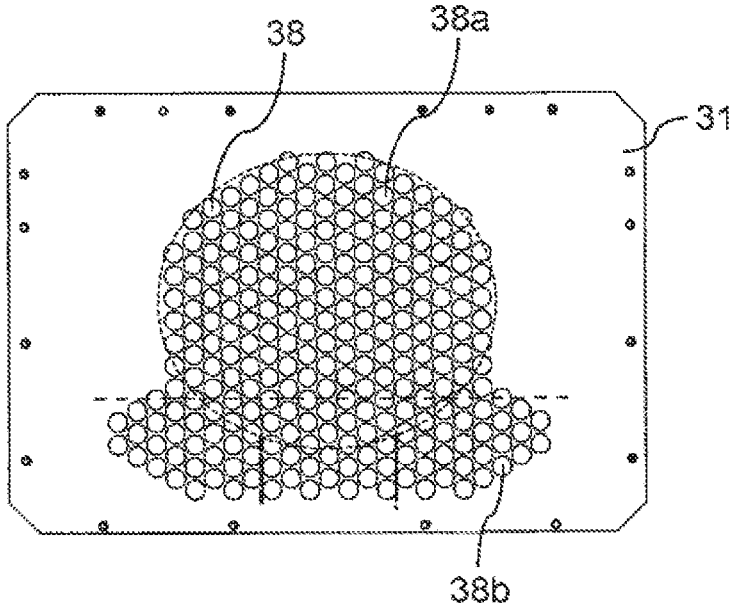
FIG. 5 is a front view of a rear wall of a heating chamber in the cooker according to the exemplary embodiment of the present disclosure.

FIG. 5 is a front view of rear wall 31. As shown in FIG. 5, rear wall 31 is formed from a metallic plate having an approximately rectangular parallelepiped shape. The plurality of openings 38 formed on rear wall 31 includes first holes 38*a* that are punching holes formed in a group in an approximately circular shape on a central portion of rear wall 31 (central portion of heating chamber 4), and second holes 38*b* that are punching holes laterally formed in a group under first holes 38*a*. On a plain face (front) of rear wall 31, the group of second holes 38*b* is formed at a lower side in heating chamber 4 so as to be more widely distributed in a left-right direction than the group of first holes 38*a*.

As will be described later, the group of first holes 38*a* formed on rear wall 31 functions as an air intake port into convection device 30, and the group of second holes 38*b* formed under the group of first holes 38*a* functions as a hot air blowing port from convection device 30.

A diameter of each of punching holes formed on a heating chamber in a conventional convection oven falls within a range from 4 mm to 5 mm inclusive. In this exemplary embodiment, a diameter of each of first holes 38*a* and second holes 38*b* forming openings 38 functioning as the air intake port and the hot air blowing port for convection device 30 is 10 mm, which is approximately twice of a diameter of punching holes in the conventional convection oven. As described above, by increasing the diameter of openings 38, a pressure loss in air passing through openings 38 can significantly be reduced, and a hot air circulation mechanism having a higher efficiency in a convection mode can be constructed.

Figure 6:
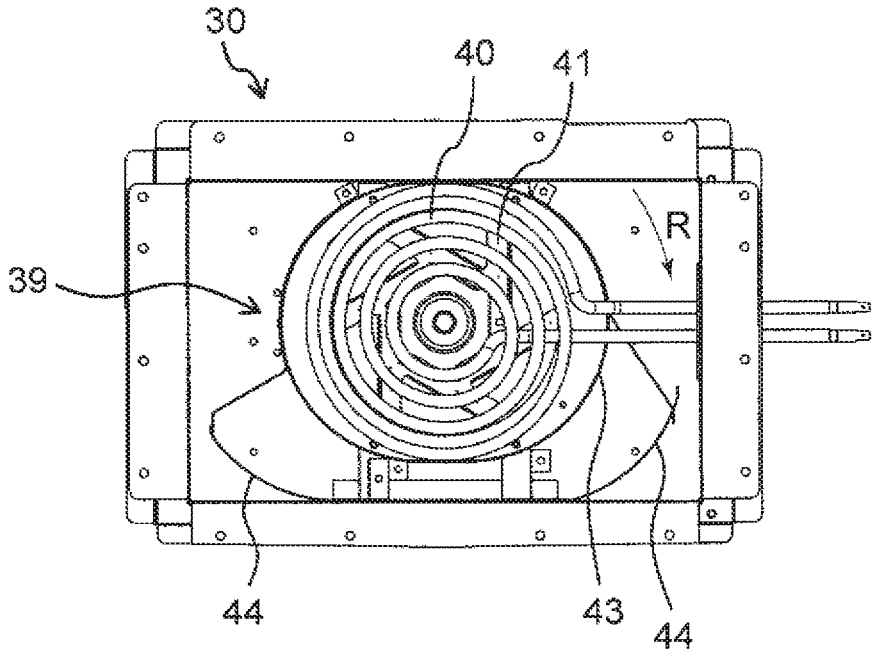
FIG. 6 is a front view of a convection device placed behind the heating chamber of the cooker according to the exemplary embodiment of the present disclosure.

As shown in FIG. 6, hot air generation mechanism 39 formed from a plurality of members for generating hot air is provided in convection device 30. Hot air generation mechanism 39 has a function to take air in heating chamber 4, to heat the taken air to generate hot air, and to blow the hot air into heating chamber 4. As described above, hot air generation mechanism 39 supplies hot air into heating chamber 4 to generate a circulating flow of the hot air in heating chamber 4.

A heating configuration of cooker 10 according to this exemplary embodiment can separately or simultaneously perform heating through radiation of heat using the grill heater provided on the ceiling wall side of heating chamber 4, heating with microwaves supplied from magnetrons 35 served as microwave generators, and heating through a circulating flow of hot air using hot air generation mechanism 39 of convection device 30. In the configuration according to this exemplary embodiment, no heater lies under an object, a liquid such as a fat component dropping from the object does not come into contact with a heater served as a heat source, and thus neither smoke nor a fire occurs.

Convection Device

Next, a configuration of convection device 30 served as the convection-heating mechanism in cooker 10 according to this exemplary embodiment will now be described herein.

Figure 7:
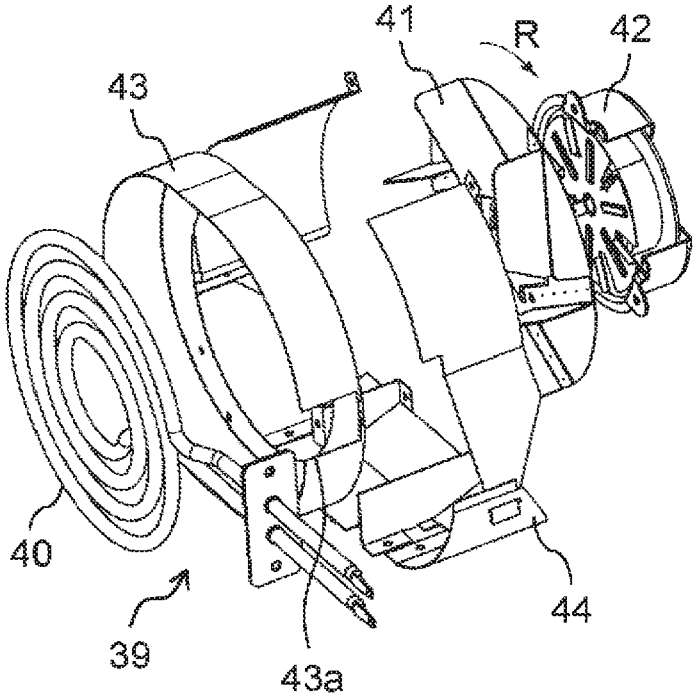
FIG. 7 is an exploded perspective view of the convection device of the cooker according to the exemplary embodiment of the present disclosure.
Figure 8:
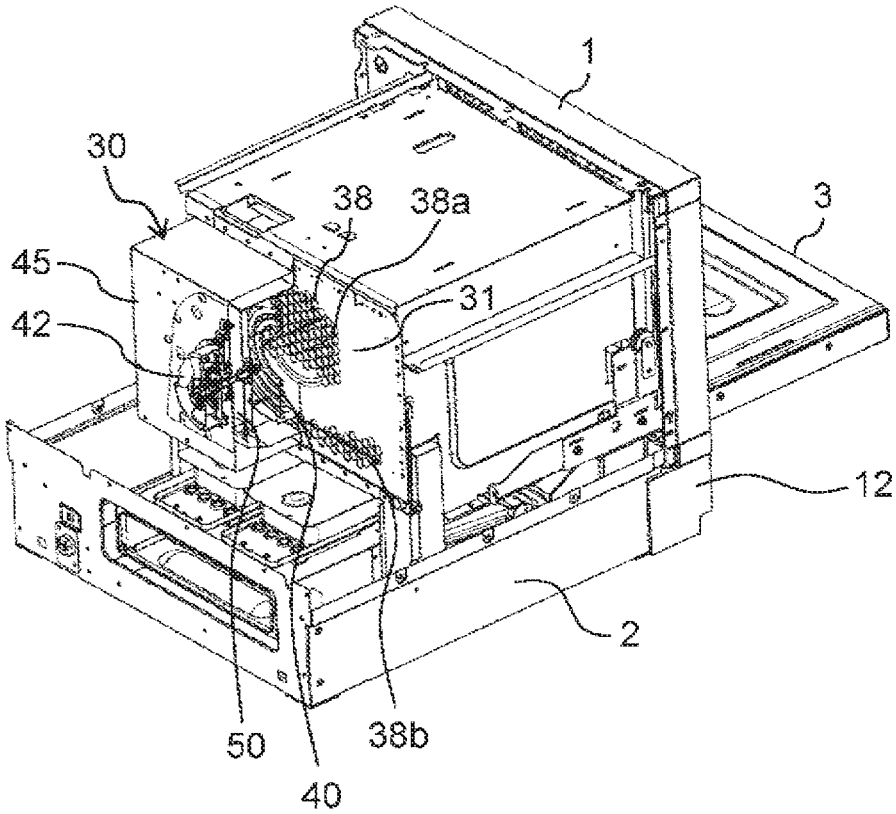
FIG. 8 is a perspective view of the cooker according to the exemplary embodiment of the present disclosure, when a housing is removed to show an arrangement of the convection device.

FIG. 3 is a front view of convection device 30 provided behind rear wall 31 of heating chamber 4. FIG. 7 is an exploded perspective view of hot air generation mechanism 39 of convection device 30. FIG. 8 is a perspective view of the cooker according to this exemplary embodiment, when a housing served as a cover of main body 1 is removed to show, in a partial cross-sectional view an arrangement of convection device 30 provided behind heating chamber 4. In FIG. 8, to show the configuration of convection device 30, convection device 30 is illustrated in a partial cross-sectional view, and another configuration than the configuration of convection device 30 is omitted.

Hot air generation mechanism 39 includes convection heater 40 provided immediately behind rear wall 31 of heating chamber 4, circulation fan 41, fan driver 42 for rotating and driving circulation fan 41, first and second hot air guides 43, 44 for guiding hot air in hot air generation mechanism 39.

A sheath heater is used to configure convection heater 40 for heating air in convection device 30. Convection heater 40 is formed in a spiral shape at a central portion of convection device 30 (which corresponds to a central portion in the heating chamber) to increase an area coming into contact with air.

Circulation fan 41 is a centrifugal fan that takes air in its central portion to blow the taken air in a centrifugal direction. The cooker according to this exemplary embodiment is configured such that, in the convection mode, circulation fan 41 takes air in heating chamber 4 into convection device 30 via openings 38 on rear wall 31 to blow the air in convection device 30 toward heating chamber 4. Circulation fan 41 is disposed behind convection heater 40, and is driven by fan driver 42 provided behind circulation fan 41. In this exemplary embodiment, a case when circulation fan 41 rotates in a direction of arrow R (see FIG. 7) will be described. However, an identical function is achieved when circulation fan 41 rotates in an opposite direction.

In FIG. 7, first hot air guide 43 is a guide member for guiding air taken into convection device 30 by circulation fan 41 to pass through an area around convection heater 40, and is disposed so as to surround convection heater 40. In this exemplary embodiment, first hot air guide 43 is formed in an approximately cylindrical shape. First hot air guide 43 is formed with cut-away portion 43*a* for allowing an extended portion of convection heater 40 to extend from inside toward outside.

Second hot air guide 44 is a member for guiding hot air blown in the centrifugal direction by circulation fan 41 toward a desired direction, and is disposed so as to externally surround circulation fan 41 and first hot air guide 43. In this exemplary embodiment, second hot air guide 44 partially abuts first hot air guide 43 outside of first hot air guide 43.

In cooker 10 according to this exemplary embodiment, which is configured as described above, upon the convection mode starts, fan driver 42 drives circulation fan 41 to take air in heating chamber 4 into convection device 30 via openings 38 (first holes 38*a*) on rear wall 31. The taken air is guided by first hot air guide 43 toward the area around convection heater 40 for being heated by convection heater 40.

Circulation fan 41 takes the air heated by convection heater 40 (hot air) to blow the air in a spiral shape toward around circulation fan 41. The air blown around by circulation fan 41 is guided by second hot air guide 44, and then guided into a lower space formed on a lower side of a space between first hot air guide 43 and second hot air guide 44. The hot air guided by first hot air guide 43 and second hot air guide 44 in convection device 30 is blown into a lower side in heating chamber 4 via openings 38 (second holes 38*b*) on rear wall 31.

As described above, a path for taking air from first holes 38*a* of openings 38 on rear wall 31 to circulation fan 41 is formed in a space surrounded by first hot air guide 43. A path for blowing hot air from circulation fan 41 to second holes 38*b* of openings 38 on rear wall 31 is formed in a space between first hot air guide 43 and second hot air guide 44. As described above, first hot air guide 43 functions as a guide plate for separating the paths for taking and blowing air in convection device 30.

As shown in FIG. 8 convection device 30 according to this exemplary embodiment, which is configured as described above, is attached to rear wall 31 configuring a wall face on a rear of heating chamber 4. In convection device 30, convection heater 40 and circulation fan 41 are covered by convection device case 45 fixed to rear wall 31.

Microwave Leak Suppression Mechanism in Convection Device

In cooker 10 according to this exemplary embodiment, the plurality of openings 38 (first holes 38*a* and second holes 38*b*) each having a diameter of 10 mm is formed on rear wall 31 of heating chamber 4 to significantly reduce a pressure loss when air passes through openings 38 on rear wall 31 in the convection mode. A diameter of each of punching holes formed in a heating chamber of a conventional convection oven ranges from 4 mm to 5 mm inclusive. In other words, openings 38 formed on rear wall 31 in this exemplary embodiment each have a diameter approximately twice the diameter of each of the punching holes in the conventional convection oven. Therefore, in the cooker according to this exemplary embodiment, a pressure loss is significantly reduced when hot air circulates, compared with the conventional convection oven.

As described above, in cooker 10 according to this exemplary embodiment, since the plurality of openings 38 (first holes 38*a* and second holes 38*b*) formed on rear wall 31 of heating chamber 4 has been formed to each have a greater diameter, an amount of microwaves radiated into heating chamber 4 and passing through openings 38 on rear wall 31 falls within approximately 2.5% to 3% (around 30 W), when the microwave-heating mode is executed. If microwaves passed through openings 38 on rear wall 31 leak outside of convection device case 45, heating efficiency would significantly lower in heat processing with the microwave-heating mode.

Cooker 10 according to this exemplary embodiment includes a plurality of microwave leak suppression mechanisms described below in order to significantly reduce microwaves leaking outside of the cooker via convection device 30, but to highly effectively perform heat processing with the microwave-heating mode.

Figure 9:
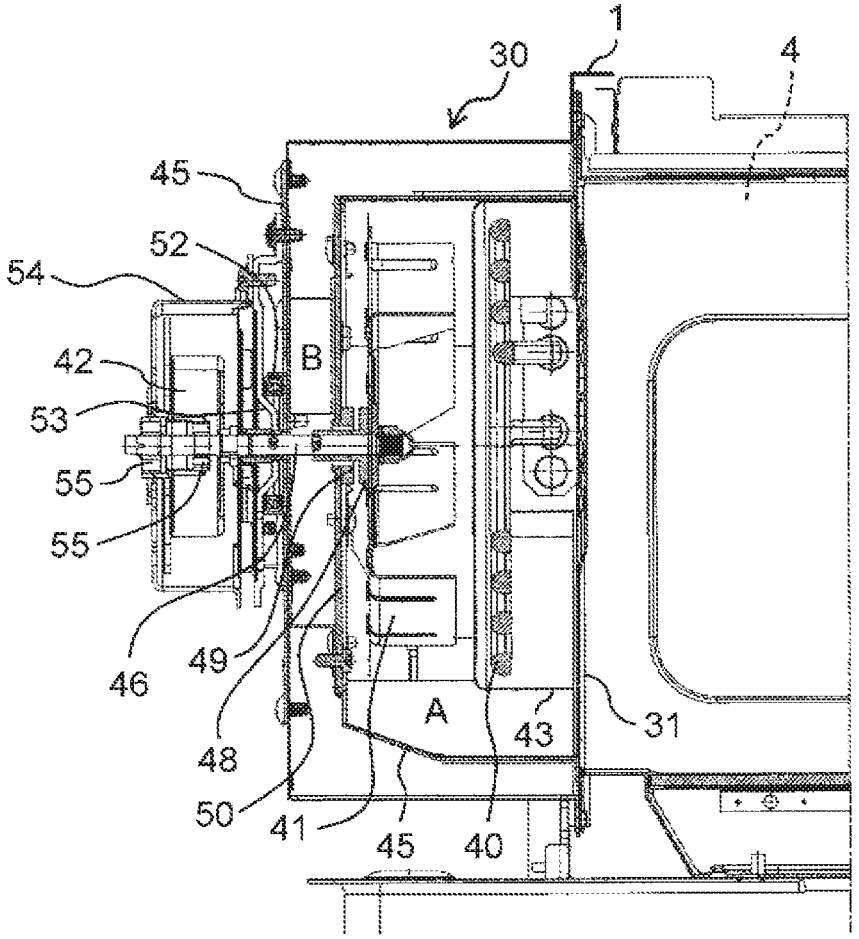
FIG. 9 is a cross-sectional view of the convection device of the cooker according to the exemplary embodiment of the present disclosure, which is taken along a rotation central axis of a circulation fan.
Figure 10:
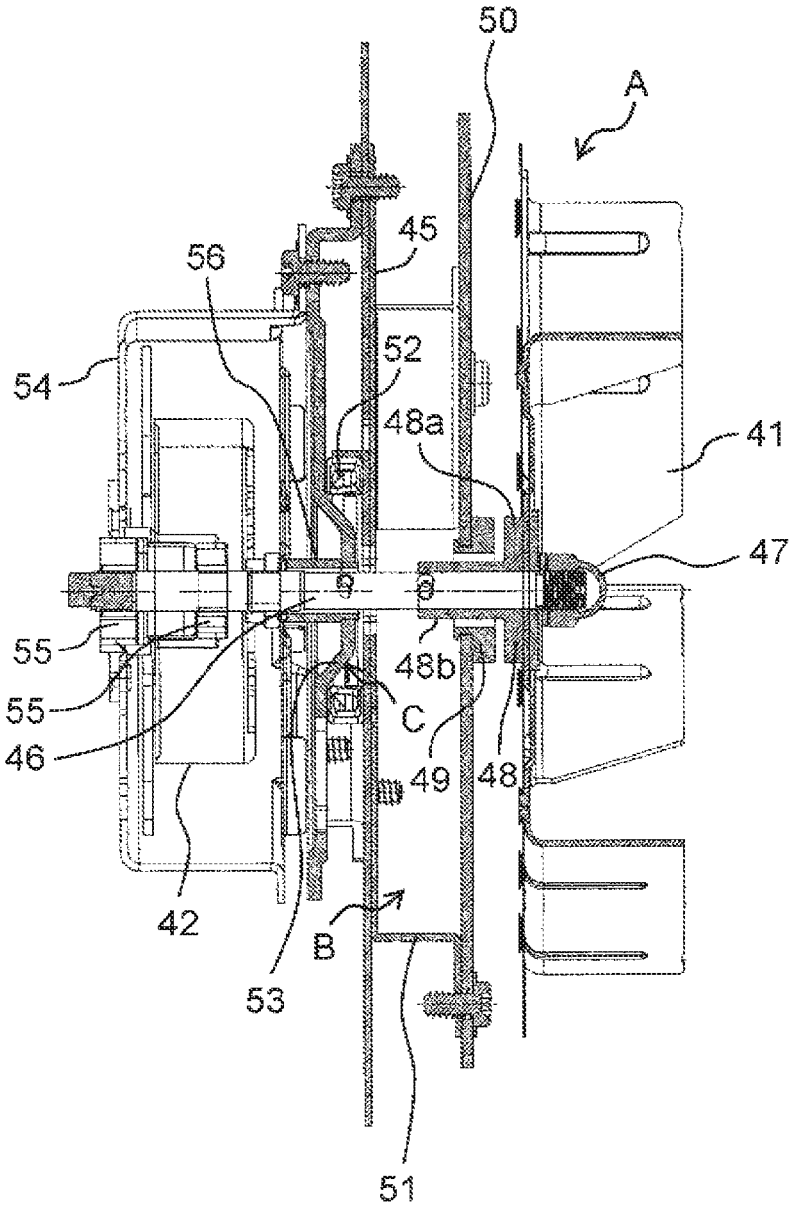
FIG. 10 is an enlarged cross-sectional view illustrating a configuration of the convection device of the cooker according to the exemplary embodiment of the present disclosure.

The microwave leak suppression mechanisms of convection device 30 according to this exemplary embodiment will now be described herein. FIG. 9 is a cross-sectional view of convection device 30 provided behind heating chamber 4, which is taken along a rotation central axis of circulation fan 41, when an outer housing covering heating chamber 4 is removed. FIG. 10 is an enlarged cross-sectional view illustrating a configuration of the convection-heating mechanism including circulation fan 41, fan driver 42, and circulation fan shaft 46 in convection device 30.

As shown in FIG. 9, convection heater 40 is provided behind rear wall 31 of heating chamber 4. Behind convection heater 40 having a spiral shape, circulation fan 41 having a rotation center approximately around convection heater 40 is provided. Circulation fan shaft 46 lying at the rotation center of circulation fan 41 is rotated and driven by a motor, i.e., fan driver 42. In this exemplary embodiment, circulation fan 41 is fixed at a front end side of circulation fan shaft 46, fan driver 42 served as the motor is provided at a rear end side of circulation fan shaft 46, and circulation fan shaft 46 is rotated and driven by fan driver 42. Circulation fan shaft 46 is rotatably held by two bearings 55 at a rear side at which fan driver 42 is provided. In other words, in this exemplary embodiment, circulation fan shaft 46 is held by bearings 55 at only one side. This is because a front side (tip side) of circulation fan shaft 46 becomes hot due to transmitted heat and microwaves radiated from heating chamber 4, and thus no bearing can be provided on the front side (tip side).

Convection space forming wall 50 served as a wall face provided immediately behind circulation fan 41 is provided behind rear wall 31. Convection space forming wall 50 and rear wall 31 form convection forming space A. Part of convection space forming wall 50 is served as second hot air guide 44 described above. Convection heater 40 and circulation fan 41 are provided in convection forming space A. Therefore, in convection forming space A, air taken from inside of heating chamber 4 is heated, and the heated air (hot air) is blown into heating chamber 4 (in this exemplary embodiment, the lower side in heating chamber 4).

Convection forming space A formed by convection space forming wall 50 (including second hot air guide 44) served as a first wall is covered by convection device case 45 served as a second wall, and fan driver case 54 covering fan driver 42 is fixed to convection device case 45 served as the second wall. Therefore, other faces than a face (rear wall 31) facing heating chamber 4 in convection forming space A according to this exemplary embodiment are formed in a double wall structure.

The plurality of microwave leak suppression mechanisms in convection device 30, which is configured as described above, is provided around circulation fan shaft 46 that rotates circulation fan 41. The plurality of microwave leak suppression mechanisms will now be described herein.

A first microwave leak suppression mechanism is a coaxial seal mechanism formed based on a gap between convection space forming wall 50 served as the first wall provided behind circulation fan 41 and circulation fan shaft 46. A second microwave leak suppression mechanism follows the first microwave leak suppression mechanism, and is formed by leak suppression space B lying behind convection space forming wall 50 (see FIG. 10). A third microwave leak suppression mechanism follows the second microwave leak suppression mechanism, and is formed by microwave sealing space C. In addition, a fourth microwave leak suppression mechanism follows the third microwave leak suppression mechanism, and is a coaxial seal mechanism formed based on a gap around circulation fan shaft 46.

As described above, in the cooker according to this exemplary embodiment, the microwave leak suppression mechanisms are provided in convection device 30 in plural stages to significantly suppress a microwave leak from convection device 30 toward outside of the cooker. According to experiments and calculations performed by the inventors of the present disclosure with a cooker having a microwave output of 1300 W, even when microwaves having an output of 30 W enter into convection device 30 via the plurality of openings 38 on rear wall 31 of heating chamber 4, the microwave leak suppression mechanisms provided in convection device 30 in plural stages have reduced a microwave output at approximately 97 dB, where only an extremely smaller amount of microwaves having an output of approximately 0.4 mW has leaked.

First Microwave Leak Suppression Mechanism

Figure 11:
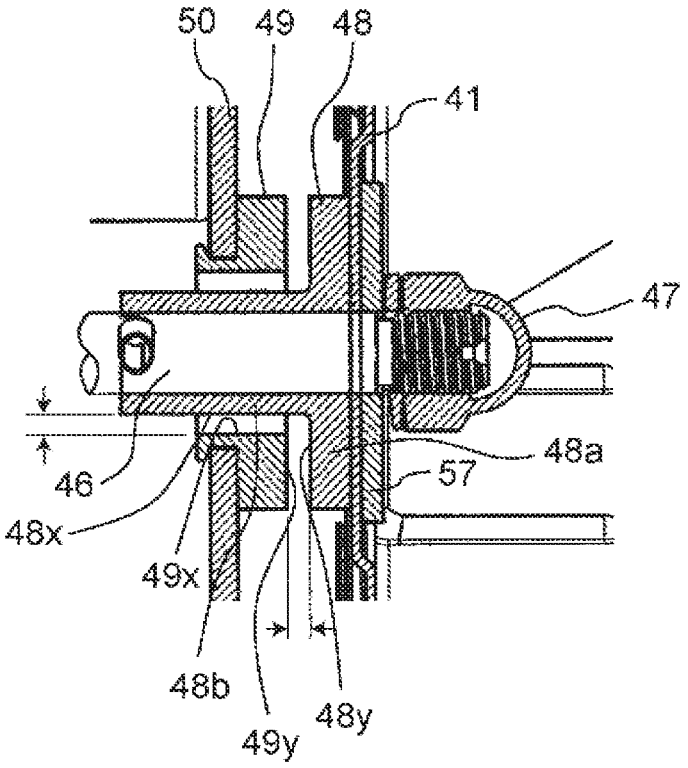
FIG. 11 is a cross-sectional view illustrating an area around a front end side of a circulation fan shaft fixed with the circulation fan of the cooker according to the exemplary embodiment of the present disclosure.

First, the first microwave leak suppression mechanism (coaxial seal mechanism) will now be described herein with reference to FIG. 11. FIG. 11 is a cross-sectional view illustrating an area around the tip side (front end side) of circulation fan shaft 46 fixed with circulation fan 41.

In FIG. 11, fan fastener 47 for fixing circulation fan 41 to circulation fan shaft 46 is screwed into a tip of circulation fan shaft 46. By screwing fan fastener 47 into the tip of circulation fan shaft 46, the central portion of circulation fan 41 is pinched and attached between fan support 48 secured around the tip side of circulation fan shaft 46 and holding plate 57.

Fan support 48 having a T-shaped cross-section is passed through by circulation fan shaft 46 and is fixed to circulation fan shaft 46. Fan support 48 includes plain face portion 48*a* having a plain face that is orthogonal to a rotation central axis of circulation fan shaft 46, and cylindrical portion 48*b* integrally formed with and projecting rearward from a center of plain face portion 48*a* so as to closely fit to an outer periphery of circulation fan shaft 46. Therefore, circulation fan 41 inserted with a tip portion of circulation fan shaft 46 screwed with fan fastener 47 into the tip portion of circulation fan shaft 46 is pinched between holding plate 57 and plain face portion 48*a* of fan support 48, and is securely fixed to circulation fan shaft 46.

As shown in FIG. 11, first bushing 49 is provided in a through hole of convection space forming wall 50 served as the first wall into which circulation fan shaft 46 passes through. First bushing 49 having a through hole at its center and formed in an annular shape is attached so as to cover an inner peripheral surface of the through hole of convection space forming wall 50 into which circulation fan shaft 46 passes through. First bushing 49 has a face opposing an outer face of fan support 48 with a predetermined distance interposed. First bushing 49 has a front end (an end in a direction toward which circulation fan 41 is provided) formed in a flat face. The flat face hereinafter will refer to opposing Y plain face 49*y*. First bushing 49 has the through hole into which cylindrical portion 48*b* of fan support 48 abutting an outer peripheral surface of circulation fan shaft 46 passes through. An inner peripheral surface of the through hole of first bushing 49 is regarded as opposing X plain face 49*x* facing an outer peripheral surface of cylindrical portion 48*b* of fan support 48.

On the other hand, in fan support 48, a rear end face on plain face portion 48*a* facing opposing Y plain face 49*y* of first bushing 49 is regarded as opposing Y plain face 48*y*. The outer peripheral surface of cylindrical portion 48*b* on fan support 48 is regarded as opposing X plain face 48*x*.

As described above, between fan support 48 and first bushing 49, opposing Y plain faces 48*y* and 49*y*, and opposing X plain faces 48*x* and 49*x* respectively are disposed to face each other with a predetermined gap interposed. Therefore, fan support 48 and first bushing 49 are provided to share the rotation central axis of circulation fan shaft 46 to configure a coaxial seal mechanism having a predetermined distance between opposing faces. In the present disclosure, a distance between opposing faces refers to a minimum distance between opposing faces. In this exemplary embodiment as shown in FIG. 11, a minimum distance in a left-right direction in a vertically extending gap between opposing Y plain faces 48*y* and 49*y* represents a distance between opposing faces, and a minimum distance in a upper-lower direction in a horizontally extending gap between opposing X plain faces 48$x$ and 49$x$ represents another distance between opposing faces.

In the configuration according to this exemplary embodiment, the gap between opposing Y plain faces 48$y$ and 49$y$ (between opposing faces) is set to 1.5 mm, and the gap between opposing X plain faces 48$x$ and 49$x$ (between opposing faces) is also set to 1.5 mm.

In this exemplary embodiment, as described above, an example is described, in which the gap between opposing Y plain faces 48$y$ and 49$y$ (between opposing faces), and the gap between opposing X plain faces 48$x$ and 49$x$ (between opposing faces) are set to 1.5 mm. However, it is preferable that a distance is as short as possible. However, as described above, in this exemplary embodiment, since circulation fan shaft 46 is held by bearings 55 provided only at a rear side, a gap of 1.0 mm or greater is preferable by taking into account vibration when the shaft rotates, and, in reality, the gap can be formed in a range from 0.8 mm to 1.2 mm inclusive. According to experiments performed by the inventors of the present disclosure, it has been found that a basic performance can be secured as long as the gap between opposing Y plain faces 48$y$ and 49$y$, and the gap between opposing X plain faces 48$x$ and 49$x$ are each 3.0 mm or smaller, in a worst case scenario. For example, as for a relation between the gap between opposing Y plain faces 48$y$ and 49$y$ and microwave leak power, results of experiments shown below have been obtained based on a plurality of samples.

When a gap (distance between opposing faces) is 1.5 mm: Microwave leak power is 0.68 W When a gap (distance between opposing faces) is 2.0 mm: Microwave leak power is 0.94 W When a gap (distance between opposing faces) is 2.2 mm: Microwave leak power is 1.20 W When a gap (distance between opposing faces) is 3.0 mm: Microwave leak power is 2.49 W When a gap (distance between opposing faces) is 3.2 mm: Microwave leak power is 7.85 W In the above described experiments and calculations, a cooker having a microwave output of 1300 W has been used, and a microwave power of 30 W has been leaked into convection forming space A of convection device 30.

Figure 12:
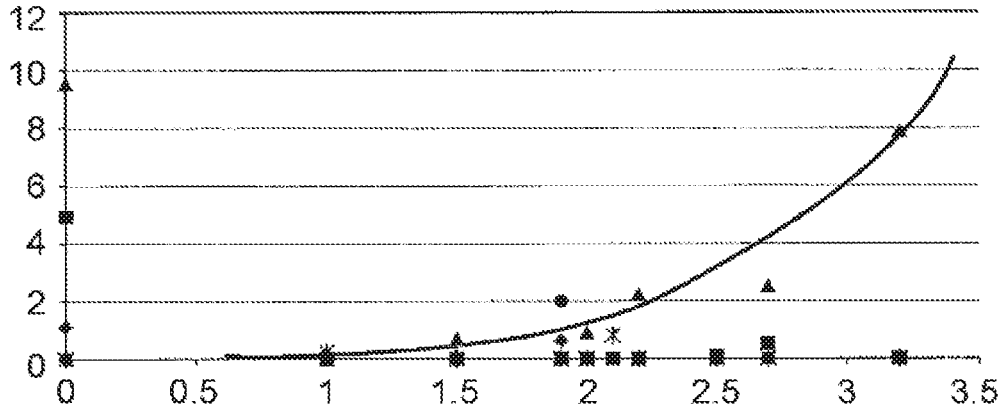
FIG. 12 is a graph rendered based on results of experiments using the cooker according to the exemplary embodiment of the present disclosure.

FIG. 12 is a graph rendered based on results of experiments regarding gaps (distances between opposing faces) and microwave leak power, as described above, where a vertical axis shows the microwave leak power [W], and a horizontal axis shows the gap between opposing Y plain faces 48$y$ and 49$y$ (distance between opposing faces) [mm]. FIG. 12 shows the results of experiments based on various samples in which a distance between opposing faces varies. As is apparent from the graph shown in FIG. 12, the microwave leak power increases greater when the gap exceeds 3.0 mm. Therefore, a preferable distance between opposing faces for securely suppressing a microwave leak is 3.0 mm or smaller. A more preferable distance between opposing faces is 2.0 mm or smaller. Further preferably, a distance between opposing faces of 1.0 mm or smaller can lead to a superior effect of suppressing a microwave leak to less than 0.5 W.

Second Microwave Leak Suppression Mechanism

The second microwave leak suppression mechanism follows the first microwave leak suppression mechanism described above, and suppresses a microwave leak of microwave power leaked from the first microwave leak suppression mechanism by leak suppression space B (see FIGS. 9 and 10) formed behind convection space forming wall 50. Leak suppression space B is a space formed to surround circulation fan shaft 46 with leak suppression wall 51 provided so as to join convection space forming wall 50 served as the first wall and convection device case 45 served as the second wall. Leak suppression space B is closed in its outer direction by leak suppression wall 51 so that convection space forming wall 50 forms a front wall face and convection device case 45 forms a back wall face. In the second microwave leak suppression mechanism configured as described above, microwaves leaked from the first microwave leak suppression mechanism interfere to each other to reduce microwave power.

Third Microwave Leak Suppression Mechanism

Figure 13:
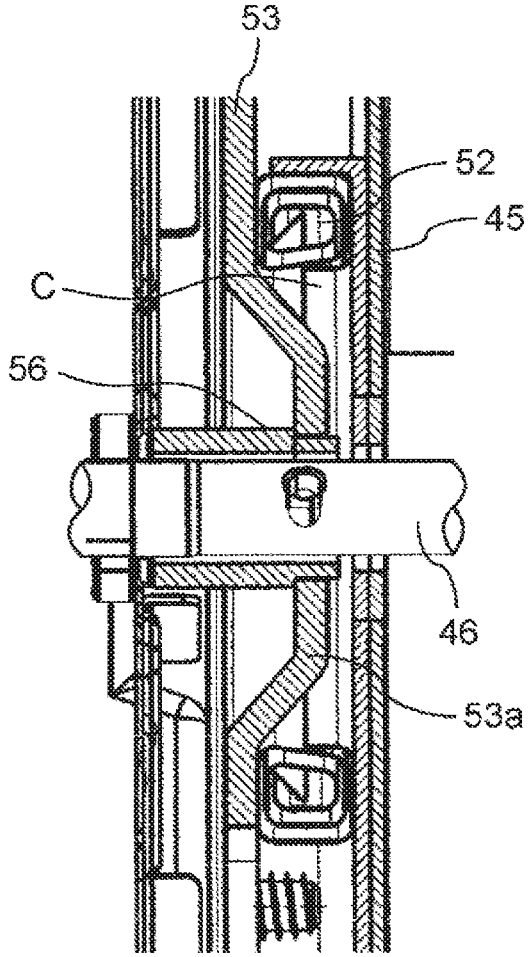
FIG. 13 is a cross-sectional view of a metal mesh seal mechanism of a microwave leak suppression mechanism and other components of the cooker according to the exemplary embodiment of the present disclosure.

The third microwave leak suppression mechanism is formed behind leak suppression space B configuring the second microwave leak suppression mechanism, and is formed by a metal mesh seal mechanism. FIG. 13 is a cross-sectional view of the metal mesh seal mechanism of the third microwave leak suppression mechanism formed behind leak suppression space B.

As shown in FIG. 13, metal mesh seal 52 is provided to closely fit to convection device case 45 forming a back wall of leak suppression space B. In this exemplary embodiment, metal mesh seal 52 is formed by gathering stainless steel mesh wires, and is disposed in an annular shape around circulation fan shaft 46. In FIG. 13 and other figures, metal mesh seal 52 is simplified.

Metal mesh seal 52 is formed by gathering mesh wires, and thus is an elastic body wholly having elasticity. Therefore, metal mesh seal 52 is pressed and securely fixed by seal pressure plate 53 fixed to convection device case 45 by means of a fastener such as a screw. However, a seal of metal mesh seal 52 is not limited to a metal mesh, and a metallic contact seal may be adopted to secure a similar performance.

The third microwave leak suppression mechanism provided as described above uses metal mesh seal 52 to seal microwaves leaked from leak suppression space B of the second microwave leak suppression mechanism via a through hole on convection device case 45, into which circulation fan shaft 46 passes through. Metal mesh seal 52 is pressed and fixed by seal pressure plate 53, into which circulation fan shaft 46 passes through, onto convection device case 45 served as the second wall. Microwave sealing space C is substantially formed inside of metal mesh seal 52 by seal pressure plate 53. In other words, microwave sealing space C is formed by convection device case 45, metal mesh seal 52, and seal pressure plate 53.

Fourth Microwave Leak Suppression Mechanism

The fourth microwave leak suppression mechanism follows the metal mesh seal mechanism served as the third microwave leak suppression mechanism. The fourth microwave leak suppression mechanism is a coaxial seal mechanism formed by second bushing 56 provided to have a predetermined gap with respect to the outer peripheral surface of circulation fan shaft 46.

As shown in FIG. 13, seal pressure plate 53 for pressing and fixing metal mesh seal 52 onto a rear face (back face) of convection device case 45 has projection 53$a$ formed in a projected shape toward a front side from around circulation fan shaft 46. Therefore, projection 53$a$ of seal pressure plate 53 is disposed at a central portion of metal mesh seal 52 disposed in an annular shape around circulation fan shaft 46. The fourth microwave leak suppression mechanism is formed by second bushing 56 made of a metal and provided to face the outer peripheral surface of circulation fan shaft 46 passing through projection 53$a$ of seal pressure plate 53.

In this exemplary embodiment, second bushing 56 is made of aluminum. However, second bushing 56 may be made of any metal, as long as the metal is a conductor. In this exemplary embodiment, a gap between the outer peripheral surface of circulation fan shaft 46 and an inner peripheral surface of second bushing 56 (distance between opposing faces) has been set to 0.5 mm. Similar to the first microwave leak suppression mechanism (coaxial seal mechanism) described above, a smaller distance between opposing faces is preferable, and a distance between opposing faces, i.e., between the outer peripheral surface of circulation fan shaft 46 and the inner peripheral surface of second bushing 56, of 0.5 mm is a distance that significantly reduces a microwave leak. A preferable distance between opposing faces, i.e., between the outer peripheral surface of circulation fan shaft 46 and the inner peripheral surface of second bushing 56, is 1.0 mm or smaller as described above for suppressing a microwave leak. The fourth microwave leak suppression mechanism has been formed to have a length of 10 mm between opposing faces in the axial direction in the coaxial seal mechanism formed by circulation fan shaft 46 and second bushing 56. However, a longer length in this axial direction is preferable.

As described above, according to the experiments and calculations using the cooker having a microwave output of 1300 W, which has been configured according to this exemplary embodiment, when a microwave power of 30 W has leaked into convection forming space A of convection device 30, and when the plurality of stages of the microwave leak suppression mechanisms starting from the first microwave leak suppression mechanism to the fourth microwave leak suppression mechanism is used, it has been confirmed that a leak has been suppressed to 0.4 mW or smaller at the final stage. Obviously, it has been confirmed that a microwave leak from convection device 30 to outside of the cooker can be securely suppressed by using a single microwave leak suppression mechanism among the first microwave leak suppression mechanism to the fourth microwave leak suppression mechanism.

The above cooker according to the exemplary embodiment has been described to have a configuration where hot air formed in convection device 30 is blown toward the lower side in heating chamber 4. However, the present disclosure is not limited to such a configuration, but may be a configuration where hot air is blown toward the upper side (ceiling side) of heating chamber 4. The cooker configured as described above can be configured to circulate, with the convection mode, hot air heated by at least one of convection heater 40 of convection device 30 and the grill heater provided on the ceiling side of heating chamber 4.

The present disclosure has been described in the exemplary embodiment in detail to a certain level. However, the contents of disclosure in the exemplary embodiment can obviously change in detailed configurations, and changes in combination and order of components in the exemplary embodiment can be achieved without departing from the scope and spirit of the appended claims of the present disclosure.

INDUSTRIAL APPLICABILITY

The present disclosure has a configuration applicable to cookers for heating and cooking an object, and in particular to high-speed cookers such as commercial microwave ovens having a microwave-heating mode and a convection mode, which are used in, for example, stores and restaurants such as convenience stores and fast-food restaurants.

REFERENCE MARKS IN THE DRAWINGS

1: main body
2: machine chamber
3: door
4: heating chamber
5: handle
6: operation unit
7: tray
8: wire rack
10: cooker
12: front grille panel
30: convection device
31: rear wall
35: magnetron
36: inverter
37: cooling fan
38: opening
39: hot air generation mechanism
40: convection heater
41: circulation fan
42: fan driver
43: first hot air guide
44: second hot air guide
45: convection device case
46: circulation fan shaft
47: fan fastener
48: fan support
49: first bushing
50: convection space forming wall
51: leak suppression wall
52: metal mesh seal
53: seal pressure plate
54: fan driver case
55: bearing
56: second bushing

The invention claimed is:

1. A cooker comprising:

a heating chamber configured to accommodate and heat an object;

a microwave-heating mechanism configured to form microwaves and radiate the microwaves into the heating chamber to heat the object with a microwave-heating mode;

a convection-heating mechanism configured to heat the object with a convection mode; and a microwave leak suppression mechanism configured to suppress a microwave leak, wherein the convection-heating mechanism includes:

a circulation fan for taking air from the heating chamber and for blowing the air into the heating chamber;

a convection heater for heating the air taken from the heating chamber by the circulation fan;

a hot air guide for guiding the air taken from the heating chamber by the circulation fan toward the convection heater, and for guiding a direction of the hot air blown into the heating chamber by the circulation fan to a desired position in the heating chamber; and a fan driver for driving a circulation fan shaft for rotating the circulation fan, the convection heater and the circulation fan are disposed in a convection forming space that is in communication with the heating chamber, the fan driver is disposed outside of the convection forming space, the microwave leak suppression mechanism includes a coaxial seal mechanism for forming a gap between the circulation fan shaft passing through a first wall forming the convection forming space and the first wall and setting the gap between opposing faces of the circulation fan shaft and the first wall to a predetermined distance or smaller, and suppresses a microwave leak from the convection forming space, the microwave leak suppression mechanism includes a fan support fixing the circulation fan at a predetermined position with respect to the circulation fan shaft, and an annular first bushing fixed so as to cover an inner face of a through hole on the first wall, into which the circulation fan shaft passes through, the fan support includes a plain face portion having a plain face for fixing the circulation fan at a predetermined position, and a cylindrical portion covering an outer peripheral surface of the circulation fan shaft that is orthogonal to the plain face of the plain face portion, and a gap between opposing faces of the first bushing and the plain face portion is 3.0 mm or smaller.

2. The cooker according to claim 1, wherein the gap between opposing faces of the circulation fan shaft and the first wall is 3.0 mm or smaller.

3. The cooker according to claim 1, wherein a gap between opposing faces of an inner peripheral surface of the first bushing and an outer peripheral surface of the cylindrical portion is 3.0 mm or smaller.

4. The cooker according to claim 3, further comprising a second wall covering the first wall forming the convection forming space with a space interposed, wherein the circulation fan shaft passes through the first wall and the second wall, the fan driver joins the circulation fan shaft passing through the second wall, and other faces than a face facing the heating chamber in the convection forming space are formed in a double wall structure.

5. The cooker according to claim 4, wherein, as the microwave leak suppression mechanism, a leak suppression wall provided so as to join the first wall and the second wall forms a leak suppression space surrounding the circulation fan shaft.

6. The cooker according to claim 4, wherein, as the microwave leak suppression mechanism, a metal mesh seal disposed in an annular shape around the circulation fan shaft passing through the second wall is provided on a side of the second wall, on which the fan driver is provided.

7. A cooker comprising:

a heating chamber configured to accommodate and heat an object;

a microwave-heating mechanism configured to form microwaves and radiate the microwaves into the heating chamber to heat the object with a microwave-heating mode;

a convection-heating mechanism configured to heat the object with a convection mode;

a microwave leak suppression mechanism configured to suppress a microwave leak, wherein the convection-heating mechanism includes:

a circulation fan for taking air from the heating chamber and for blowing the air into the heating chamber;

a convection heater for heating the air taken from the heating chamber by the circulation fan;

a hot air guide for guiding the air taken from the heating chamber by the circulation fan toward the convection heater, and for guiding a direction of the hot air blown into the heating chamber by the circulation fan to a desired position in the heating chamber; and a fan driver for driving a circulation fan shaft for rotating the circulation fan, the convection heater and the circulation fan are disposed in a convection forming space that is in communication with the heating chamber, the fan driver is disposed outside of the convection forming space, and the microwave leak suppression mechanism includes a coaxial seal mechanism for forming a gap between the circulation fan shaft passing through a first wall forming the convection forming space and the first wall and setting the gap between opposing faces of the circulation fan shaft and the first wall to a predetermined distance or smaller, and suppresses a microwave leak from the convection forming space;

wherein the gap between opposing faces of the circulation fan shaft and the first wall is 3.0 mm or smaller;

wherein:

the microwave leak suppression mechanism includes:

a fan support fixing the circulation fan at a predetermined position with respect to the circulation fan shaft, and an annular first bushing fixed so as to cover an inner face of a through hole on the first wall, into which the circulation fan shaft passes through, and a gap between opposing faces of the fan support and the first bushing is 3.0 mm or smaller when the fan support passes through the first bushing;

wherein:

the fan support includes a plain face portion having a plain face for fixing the circulation fan at a predetermined position, and a cylindrical portion covering an outer peripheral surface of the circulation fan shaft that is orthogonal to the plain face of the plain face portion, a gap between opposing faces of an inner peripheral surface of the first bushing and an outer peripheral surface of the cylindrical portion is 3.0 mm or smaller, and a gap between opposing faces of the first bushing and the plain face portion is 3.0 mm or smaller;

a second wall covering the first wall forming the convection forming space with a space interposed, wherein:

the circulation fan shaft passes through the first wall and the second wall, the fan driver joins the circulation fan shaft passing through the second wall, and other faces than a face facing the heating chamber in the convection forming space are formed in a double wall structure;

wherein, as the microwave leak suppression mechanism, a metal mesh seal disposed in an annular shape around the circulation fan shaft passing through the second wall is provided on a side of the second wall, on which the fan driver is provided; and wherein the metal mesh seal is pressed and fixed to the second wall by a seal pressure plate into which the circulation fan shaft passes through, and the seal pressure plate forms a microwave sealing space in the metal mesh seal.

8. The cooker according to claim 7, wherein, as the microwave leak suppression mechanism, a second bushing fixed to the seal pressure plate and disposed on the outer peripheral surface of the circulation fan shaft to have a predetermined gap is provided, the second bushing having a coaxial seal function.

9. The cooker according to claim 8, wherein a gap between opposing faces of an inner peripheral surface of the second bushing and the outer peripheral surface of the circulation fan shaft is 1.0 mm or smaller.

10. The cooker according to claim 1, wherein the first bushing and the plain face portion opposes in a direction of an axis of the circulation fan shaft.

11. The cooker according to claim 1, further comprising a rear wall configuring a back wall of the heating chamber, wherein a plurality of openings is formed on the rear wall, a diameter of the plurality of openings being within a range from 8 mm to 10 mm.

12. A cooker comprising:

a heating chamber configured to accommodate and heat an object;

a microwave-heating mechanism configured to form microwaves and radiate the microwaves into the heating chamber to heat the object with a microwave-heating mode;

a convection-heating mechanism configured to heat the object with a convection mode; and a microwave leak suppression mechanism configured to suppress a microwave leak, wherein:

the convection-heating mechanism includes:

a circulation fan for taking air from the heating chamber and for blowing the air into the heating chamber;

a convection heater for heating the air taken from the heating chamber by the circulation fan;

a hot air guide for guiding the air taken from the heating chamber by the circulation fan toward the convection heater, and for guiding a direction of the hot air blown into the heating chamber by the circulation fan to a desired position in the heating chamber; and a fan driver for driving a circulation fan shaft for rotating the circulation fan, the convection heater and the circulation fan are disposed in a convection forming space that is in communication with the heating chamber, the fan driver is disposed outside of the convection forming space, the microwave leak suppression mechanism includes a coaxial seal mechanism for forming a gap between the circulation fan shaft passing through a first wall forming the convection forming space and the first wall and setting the gap between opposing faces of the circulation fan shaft and the first wall to a predetermined distance or smaller, and suppresses a microwave leak from the convection forming space, the cooker further comprises a second wall covering the first wall forming the convection forming space with a space interposed, the circulation fan shaft passes through the first wall and the second wall, as the microwave leak suppression mechanism, a metal mesh seal disposed in an annular shape around the circulation fan shaft passing through the second wall is provided on a side of the second wall, on which the fan driver is provided, and the metal mesh seal is pressed and fixed to the second wall by a seal pressure plate into which the circulation fan shaft passes through, and the seal pressure plate forms a microwave sealing space in the metal mesh seal.

* * * * *